US006635187B1

(12) United States Patent
Mahler et al.

(10) Patent No.: US 6,635,187 B1
(45) **Date of Patent: *Oct. 21, 2003**

(54) COMPOSITIONS COMPRISING HYDROFLUOROCARBONS AND THEIR MANUFACTURE

(75) Inventors: Barry A. Mahler, Glen Mills, PA (US); V. N. Mallikarjuna Rao, Wilmington, DE (US); Allen Capron Sievert, Elkton, MD (US)

(73) Assignee: E. I. du Pont de Nemours and Company, Wilmington, DE (US)

( * ) Notice: Subject to any disclaimer, the term of this patent is extended or adjusted under 35 U.S.C. 154(b) by 262 days.

This patent is subject to a terminal disclaimer.

(21) Appl. No.: 09/713,128

(22) Filed: Nov. 15, 2000

Related U.S. Application Data

(62) Division of application No. 09/137,343, filed on Aug. 20, 1998, now Pat. No. 6,224,781.
(60) Provisional application No. 60/056,796, filed on Aug. 25, 1997.

(51) Int. Cl.[7] ..... A62D 1/06; A62D 1/00
(52) U.S. Cl. ..... 252/2; 252/67; 252/69; 252/77; 252/264; 510/408; 510/410; 510/411
(58) Field of Search ..... 252/2, 67, 69, 252/77, 364; 510/408, 410, 411

(56) References Cited

U.S. PATENT DOCUMENTS

| | | | | |
|---|---|---|---|---|
| 2,599,631 A | | 6/1952 | Harmon | 260/653 |
| 2,745,886 A | | 5/1956 | Ruh et al. | 260/653 |
| 3,673,113 A | | 6/1972 | Naito et al. | 252/441 |
| 4,034,070 A | | 7/1977 | Wojtowicz et al. | 423/489 |
| 4,053,530 A | | 10/1977 | Schindel | 260/653.8 |
| 4,158,023 A | | 6/1979 | von Halasz | 260/653.9 |
| 4,465,786 A | | 8/1984 | Zimmer et al. | 502/169 |
| 4,741,893 A | | 5/1988 | Watanabe et al. | 423/471 |
| 5,084,190 A | | 1/1992 | Fernandez | 252/8 |
| 5,169,873 A | | 12/1992 | Behme et al. | 521/114 |
| 5,182,040 A | | 1/1993 | Bartlett et al. | |
| 5,196,616 A | | 3/1993 | Lee et al. | 570/178 |
| 5,262,077 A | | 11/1993 | Bivens et al. | 252/67 |
| 5,444,102 A | | 8/1995 | Nimitz et al. | 521/131 |
| 5,461,177 A | | 10/1995 | Manzer et al. | |
| 5,648,016 A | | 7/1997 | Klug et al. | 252/67 |
| 5,725,791 A | | 3/1998 | Bivens et al. | |
| 5,856,587 A | | 1/1999 | Visca et al. | 568/677 |
| 5,968,406 A | | 10/1999 | Bartlett et al. | |
| 6,028,026 A | | 2/2000 | Rao et al. | 502/228 |
| 6,031,141 A | | 2/2000 | Mallikarjuna et al. | 570/136 |
| 6,107,267 A | | 8/2000 | Rao et al. | 510/408 |
| 6,224,781 B1 | * | 5/2001 | Mahler et al. | 252/2 |
| 6,376,727 B1 | * | 4/2002 | Rao et al. | 203/67 |

FOREIGN PATENT DOCUMENTS

| | | | | |
|---|---|---|---|---|
| DE | 2900854 | | 7/1979 | 423/489 |
| EP | 0605683 | * | 9/1997 | |
| WO | WO 93/25506 | | 12/1993 | C07C/17/20 |
| WO | WO 94/06558 | | 3/1994 | B01J/23/92 |
| WO | WO 96/05157 | | 2/1996 | C07C/17/25 |
| WO | WO 97/07052 | | 2/1997 | C01B/7/19 |
| WO | WO 98/37043 | | 8/1998 | |

OTHER PUBLICATIONS

L.E. Manzer et al., *Adv. Catal.,* 39, 329–350, 1993.
*Ullman's Encyclopedia of Industrial Chemistry,* Fifth Ed., vol. A7, 83.

(List continued on next page.)

*Primary Examiner*—Jill Warden
*Assistant Examiner*—Latoya I. Cross

(57) ABSTRACT

A process is disclosed for producing compositions including (a) a compound selected from the group consisting of $CHF_2CF_3$, $CHF_2CHF_2$, $CH_2FCF_3$, $CH_3CF_3$, $CH_3CHF_2$, $CH_2FCF_2CHF_2$ and $CHF_2CF_2CF_2CHF_2$ and (b) at least one saturated halogenated hydrocarbon and/or ether having the formula:

$$C_nH_{2n+2-a-b}Cl_aF_bO_c$$

wherein n is an integer from 1 to 4, a is an integer from 0 to 2n+1, b is an integer from 1 to 2n+2-a, and c is 0 or 1, provided that when c is 1 then n is an integer from 2 to 4, and provided that component (b) does not include the selected component (a) compound, wherein the molar ratio of component (b) to component (a) is between about 1:99 and a molar ratio of HF to component (a) in an azeotrope or azeotrope-like composition of component (a) with HF. This process involves (A) combining (i) the azeotrope or azeotrope-like composition with (ii) at least one fluorination precursor compound wherein the precursor component (ii) is the fluorination precursor to component (b); and (B) reacting a sufficient amount of the HF from the azeotrope or azeotrope-like composition (i) with precursor component (ii) to provide a composition containing components (a) and (b) in said ratio.

In addition, compositions are disclosed comprising component (a) (e.g., $CHF_2CHF_2$), and component (b) wherein component (b) includes at least two compounds, at least one of which is an ether, and the molar ratio of component (b) to component (a) is between about 1:99 and a molar ratio of HF to component (a) in an azeotrope or azeotrope-like composition of component (a) with HF.

Also disclosed is a process for recovering HF from a product mixture comprising HF and $CHF_2CHF_2$, which involves distilling the product mixture to remove all products which have a lower boiling point than the lowest boiling azeotrope containing HF and $CHF_2CHF_2$; and distilling said azeotrope to recover HF as an azeotropic composition containing HF and $CHF_2CHF_2$; and compositions of hydrogen fluoride in combination with an effective amount of $CHF_2CHF_2$ to form an azeotrope or azeotrope-like composition with hydrogen fluoride (e.g., compositions containing from about 70.5 to 75.5 mole percent $CHF_2CHF_2$).

12 Claims, No Drawings

OTHER PUBLICATIONS

B.D. Cullity, Elements of X–Ray Diffraction, *Addison–Wesley Publishing Company, Inc.,* 34–41.

P. Daniel et al., Raman–scattering study of crystallized MF3 compounds (M=Al, Cr, GA, V, Fe, In): An approach to the short–range–order force constants, *The American Physical Society,* 42, 10545–10552, Dec. 1, 1990.

Keshav N. Shrivastava, Theory of the –electron spin density dur to the Cr3+ ion and Cr3+ ion pair in a cubic fluoride lattice., *Physical Review,* 20, 5375–5378, Dec. 15, 1979.

Kerro Knox, Structure of Chromium (III) Fluoride, *Short Communications,* 13, 507–508, 1960.

* cited by examiner

COMPOSITIONS COMPRISING HYDROFLUOROCARBONS AND THEIR MANUFACTURE

This application is a division of U.S. application Ser. No. 09/137,343 now U.S. Pat. No. 6,224,781 filed Aug. 20, 1998, and claims the priority benefit of U.S. Provisional Application No. 60/056,796, filed Aug. 25, 1997.

FIELD OF THE INVENTION

This invention relates to azeotropic compositions of hydrogen fluoride with halogenated hydrocarbons, their production and their use in manufacturing processes for producing halogenated hydrocarbon mixtures.

BACKGROUND

Hydrofluorocarbons (HFCs), compounds containing only carbon. hydrogen and fluorine, because of their zero ozone depletion potential, are of interest as environmentally attractive alternatives for chlorofluorocarbons (i.e., CFCs) in such established uses as refrigerants, heat transfer media, foam expansion agents, aerosol propellants, solvents, fire extinguishants and power cycle working fluids, among other applications.

Hydrofluorocarbons can be obtained by reacting chlorohalocarbons with HF using various catalysts. For example $CHF_2CHF_2$ (i.e., 1,1,2,2-tetrafluoroethane or HFC-134) can be prepared by reacting 1,1,2,2-tetrachloroethane with HF over a fluorination catalyst/agent in the liquid or vapor phase (see Int. Publ. No. WO 93/25506). Normally, excess HF is used to achieve relatively favorable reactor rates. HF may be removed from the halogenated hydrocarbon components of the product mixture using conventional aqueous solution scrubbing techniques. However, the production of substantial amounts of scrubbing discharge can create aqueous waste disposal concerns.

There remains a need for processes utilizing HF in such product mixtures as well as an interest in developing more efficient processes for the manufacture of hydrofluorocarbons.

SUMMARY OF THE INVENTION

This invention provides a process for producing compositions comprising (a) a compound selected from the group consisting of $CHF_2CF_3$, $CHF_2CHF_2$, $CH_2FCF_3$, $CH_3CF_3$, $CH_3CHF_2$, $CH_2FCF_2CHF_2$ and $CHF_2CF_2CF_2CHF_2$ and (b) at least one saturated compound selected from halogenated hydrocarbons and ethers having the formula:

$$C_nH_{2n+2-a-b}Cl_aF_bO_c$$

wherein n is an integer from 1 to 4, a is an integer from 0 to 2n+1, b is an integer from 1 to 2n+2-a, and c is 0 or 1, provided that when c is 1 then n is an integer from 2 to 4, and provided that component (b) does not include the selected component (a) compound, wherein the molar ratio of component (b) to component (a) is between about 1:99 and a molar ratio of HF to component (a) in an azeotrope or azeotrope-like composition of component (a) with HF. This process comprises (A) combining (i) said azeotrope or azeotrope-like composition with (ii) at least one fluorination precursor compound wherein the precursor component (ii) is the fluorination precursor to component (b); and (B) reacting a sufficient amount of the HF from the azeotrope or azeotrope-like composition (i) with precursor component (ii) to provide a composition containing components (a) and (b) in said ratio.

In addition, compositions are provided comprising (a) a compound selected from the group consisting of $CHF_2CF_3$, $CHF_2CHF_2$, $CH_2FCF_3$, $CH_3CF_3$, $CH_3CHF_2$, $CH_2FCF_2CHF_2$ and $CHF_2CF_2CF_2CHF_2$ (e.g., $CHF_2CHF_2$), and (b) at least two saturated compounds selected from halogenated hydrocarbons and ethers having the formula:

$$C_nH_{2n+2-a-b}Cl_aF_bO_c$$

wherein n is an integer from 1 to 4, a is an integer from 0 to 2n+1, b is an integer from 1 to 2n+2-a, and c is 0 or 1, provided that when c is 1 then n is an integer from 2 to 4, provided that component (b) does not include the selected component (a) compound, and provided that c is 1 for at least one of the component (b) compounds, wherein the molar ratio of component (b) to component (a) is between about 1:99 and a molar ratio of HF to component (a) in an azeotrope or azeotrope-like composition of component (a) with HF.

The present invention further provides a process for recovering HF from a product mixture comprising HF and $CHF_2CHF_2$. The process comprises (1) distilling the product mixture to remove all products which have a lower boiling point than the lowest boiling azeotrope containing HF and $CHF_2CHF_2$; and (2) distilling said azeotrope to recover HF as an azeotropic composition containing HF and $CHF_2CHF_2$.

Also provided are compositions which consist essentially of hydrogen fluoride in combination with an effective amount of $CHF_2CHF_2$ to form an azeotrope or azeotrope-like composition with hydrogen fluoride, said composition containing from about 70.5 to 75.5 mole percent $CHF_2CHF_2$.

DETAILED DESCRIPTION OF THE INVENTION

The present invention provides compositions which consist essentially of hydrogen fluoride and an effective amount of $CHF_2CHF_2$ to form an azeotropic combination with hydrogen fluoride. By effective amount is meant an amount which, when combined with HF, results in the formation of an azeotrope or azeotrope-like mixture. As recognized in the art, an azeotrope or an azeotrope-like composition is an admixture of two or more different components which, when in liquid form under given pressure, will boil at a substantially constant temperature, which temperature may be higher or lower than the boiling temperatures of the individual components, and which will provide a vapor composition essentially identical to the liquid composition undergoing boiling.

An azeotrope is a liquid mixture that exhibits a maximum or minimum boiling point relative to the boiling points of surrounding mixture compositions. An azeotrope is homogeneous if only one liquid phase is present. An azeotrope is heterogeneous if more than one liquid phase is present. Regardless, a characteristic of minimum boiling azeotropes is that the bulk liquid composition is then identical to the vapor composition in equilibrium therewith, and distillation is ineffective as a separation technique. For the purpose of this discussion, azeotrope-like composition means a composition which behaves like an azeotrope (i.e., has constant-boiling characteristics or a tendency not to fractionate upon boiling or evaporation). Thus, the composition of the vapor formed during boiling or evaporation of such compositions is the same as or substantially the same as the original liquid composition. Hence, during boiling or evaporation, the liquid composition, if it changes at all, changes only to a minimal or negligible extent. This is to be contrasted with non-azeotrope-like compositions in which during boiling or evaporation, the liquid composition changes to a substantial degree.

Accordingly, the essential features of an azeotrope or an azeotrope-like composition are that at a given pressure, the boiling point of the liquid composition is fixed and that the composition of the vapor above the boiling composition is essentially that of the boiling liquid composition (i.e., no fractionation of the components of the liquid composition takes place). It is also recognized in the art that both the boiling point and the weight percentages of each component of the azeotropic composition may change when the azeotrope or azeotrope-like liquid composition is subjected to boiling at different pressures. Thus an azeotrope or an azeotrope-like composition may be defined in terms of the unique relationship that exists among components or in terms of the compositional ranges of the components or in terms of exact weight percentages of each component of the composition characterized by a fixed boiling point at a specified pressure. It is also recognized in the art that various azeotropic compositions (including their boiling points at particular pressures) may be calculated (see, e.g., W. Schotte, Ind. Eng. Chem. Process Des. Dev. 1980, 19, pp 432–439). Experimental identification of azeotropic compositions involving the same components may be used to confirm the accuracy of such calculations and/or to modify the calculations for azeotropic compositions at the same or other temperatures and pressures.

A composition may be formed which consists essentially of azeotropic combinations of hydrogen fluoride and $CHF_2CHF_2$. This includes a composition consisting essentially of from about 24.5 to about 29.5 mole percent HF and from about 75.5 to about 70.5 mole percent $CHF_2CHF_2$ (which forms an azeotrope boiling at a temperature from between about −40° C. and about 0° C. and a pressure from between about 39 kPa and about 240 kPa).

At atmospheric pressure, the boiling points of hydrofluoric acid and HFC-134 are about 19.5° C. and −23° C., respectively. However, the relative volatility at 105 kPa (15.2 psia) and −20° C. of HF and HFC-134 was found to be nearly 1.0 as 25 mole percent HF and 75 mole percent HFC-134 was approached. These data indicate that the use of conventional distillation procedures will not result in the separation of a substantially pure compound because of the low value of relative volatility of the compounds.

To determine the relative volatility of HF with HFC-134, the so-called PTx Method was used. In this procedure, the total absolute pressure in a cell of known volume is measured at a constant temperature for various known binary compositions. Use of the PTx Method is described in greater detail in "*Phase Equilibrium in Process Design*", Wiley-Interscience Publisher, 1970, written by Harold R. Null, on pages 124 to 126, the entire disclosure of which is hereby incorporated by reference. Samples of the vapor and liquid, or vapor and each of the two liquid phases under those conditions where two liquid phases exist, were obtained and analyzed to verify their respective compositions.

These measurements can be reduced to equilibrium vapor and liquid compositions in the cell by an activity coefficient equation model, such as the Non-Random, Two-Liquid (NRTL) equation, to represent liquid phase non-idealities. Use of an activity coefficient equation, such as the NRTL equation, is described in greater detail in "*The Properties of Gases and Liquids*", 4th Edition, publisher McGraw Hill, written by Reid, Prausnitz and Poling, on pages 241 to 387; and in "*Phase Equilibria in Chemical Engineering*", published by Butterworth Publishers, 1985, written by Stanley M. Walas, pages 165 to 244; the entire disclosure of each of the previously identified references are hereby incorporated by reference.

Without wishing to be bound by any theory or explanation, it is believed that the NRTL equation can sufficiently predict whether or not mixtures of HF and HFC-134 behave in an ideal manner, and can sufficiently predict the relative volatilities of the components in such mixtures. Thus, while HF has a good relative volatility compared to HFC-134 at low HFC-134 concentrations, the relative volatility becomes nearly 1.0 as 75 mole percent HFC-134 was approached at −20° C. This would make it impossible to separate HFC-134 from HF by conventional distillation from such a mixture. Where the relative volatility approaches 1.0 defines the system as forming a near-azeotrope. Where the relative volatility is 1.0 defines the system as forming an azeotrope.

Azeotropes of HF and HFC-134 are formed at a variety of temperatures and pressures. At a pressure of 15.2 psia (105 kPa) and −20° C., the azeotrope vapor composition was found to be about 25 mole percent HF and about 75 mole percent HFC-134. Based upon the above finding, it has been calculated that an azeotropic composition of about 29.5 mole percent HF and about 70.5 mole percent HFC-134 can be formed at −40° C. and 5.6 psia (39 kPa) and an azeotropic composition of about 24.5 mole percent HF and about 75.5 mole percent HFC-134 can be formed at 0° C. and 34.8 psia (240 kPa). Accordingly, the present invention provides an azeotrope or azeotrope-like composition consisting essentially of from about 29.5 to 24.5 mole percent HF and from about 70.5 to 75.5 mole percent HFC-134, said composition having a boiling point from about −40° C. at 39 kPa to about 0° C. at 240 kPa.

The HFC-134 can be separated from its azeotrope with HF by conventional means such as neutralization and decantation. However the azeotropic composition of HFC-134 and HF is useful as recycle to a fluorination reactor, where the recycled HF can function as a reactant and the recycled HFC-134 can function to moderate the heat of reaction. It will also be apparent to one of ordinary skill in the art that distillation including azeotropes with HF can typically be run under more convenient conditions than distillation without HF (e.g., where HF is removed prior to distillation).

The HFC-134/HF azeotrope, as well as HFC-134a/HF, HFC-134a/HF, HFC-125/HF, HFC-152a/HF, HFC-245ca/HF and HFC-338pcc/HF azeotropes can be used as an HF source to fluorinate numerous compounds. Optionally, such fluorinations can employ a fluorination catalyst. The fluorinations can be done in the liquid phase using typical catalysts such as $SbCl_5$. The fluorinations can also be done in the vapor phase using typical catalysts such as $Cr_2O_3$. Of note, however, are vapor phase fluorinations in the presence of a catalytic composition comprising cubic chromium trifluoride (i.e., chromium trifluoride having an X-ray diffraction powder pattern as shown in Table I.

TABLE I

Powder X-ray diffraction Data for Cubic-$CrF_3$

| d spacing (Å) | Relative intensity[a] | H | K | L |
|---|---|---|---|---|
| 5.8888 | VS[b] | 1 | 1 | 1 |
| 3.0674 | S[c] | 3 | 1 | 1 |

TABLE I-continued

Powder X-ray diffraction Data for Cubic-$CrF_3$

| d spacing (Å) | Relative intensity[a] | H | K | L |
|---|---|---|---|---|
| 2.9423 | M[d] | 2 | 2 | 2 |
| 2.0818 | W[e] | 4 | 2 | 2 |
| 1.9547 | W[e] | 5 | 1 | 1 |
| 1.7991 | M[d] | 4 | 4 | 0 |

[a]as recorded at room temperature using a conventional diffractometer such as SCINTAG (PAD IV) diffractometer with copper k-alpha radiation
[b]VS means very strong (e.g., a relative intensity of about 100)
[c]S means strong (e.g., a relative intensity of about 46)
[d]M means moderate (e.g., a relative intensity of about 33 and about 14 for d spacing of 2.9423 and 1.7991, respectively)
[e]W means weak (e.g., a relative intensity of about 7 and about 4 for d spacing of 2.0818 and 1.9547, respectively)

Cubic chromium trifluoride may be prepared from $CrF_3 \cdot XH_2O$, where X is 3 to 9, preferably 4, by heating in air or an inert atmosphere (e.g., nitrogen or argon) at 350° C. to 400° C. for 3 to 12 hours, preferably 3 to 6 hours. The color of cubic chromium trifluoride is dark green. Cubic chromium trifluoride is useful by itself and together with other chromium compounds, as a catalytic material. Of note are catalyst compositions comprising chromium wherein at least 10% of the chromium is in the form of cubic chromium trifluoride, particularly catalyst compositions wherein at least 25% of the chromium is in the form of cubic chromium trifluoride, and especially catalyst compositions wherein at least 60% of the chromium is in the form of cubic chromium trifluoride. The chromium, including the cubic chromium trifluoride can be supported on and/or physically mixed with materials such as carbon, aluminum fluoride, fluorided alumina, lanthanum fluoride, magnesium fluoride, calcium fluoride, zinc fluoride and the like. Preferred are combinations including cubic chromium trifluoride in combination with magnesium fluoride and/or zinc fluoride. Chromium trifluoride catalyst which consists essentially of cubic chromium trifluoride can also be prepared and used in accordance with this invention.

By fluorination precursors to the component (b) compound(s) is meant compounds which react with HF (optionally in the presence of a fluorination catalyst) to produce the corresponding component (b) compound(s). Fluorination precursors include saturated compounds having the formula $$C_nH_{2n+2-a-b}Cl_{a+x}F_{b-x}O_c$$

wherein x is an integer from 1 to b. Examples of saturated precursors and corresponding products are as follows:

| SATURATED PRECURSOR | PRODUCT |
|---|---|
| $CH_2CCl_2$ | $CH_2CF_2$ |
| $CHCl_2CHCl_2$ | $CHF_2CHF_2$ |
| $CF_3CH_2Cl$ | $CF_3CH_2F$ |
| $CH_2ClCF_2CHF_2$ | $CH_2FCF_2CHF_2$ |
| $CH_3CF_2CCl_3$ | $CH_3CF_2CF_3$ |
| $CHCl_2CH_2CCl_3$ | $CHF_2CH_2CF_3$ |
| $CHCl_2OCF_2CHF_2$ | $CHF_2OCF_2CHF_2$ |
| $CF_3CHClOCHF_2$ | $CF_3CHFOCHF_2$ |
| $CHF_2OCHCl_2$ | $CHF_2OCHF_2$ |
| $CClF_2OCHF_2$ | $CF_3OCHF_2$ |

Fluorination precursors also include unsaturated compounds having the formula $$C_nH_{2n+1-a-b}Cl_{a+y}F_{b-y-1}O_c$$

wherein y is an integer from 0 to b-1. Examples of unsaturated precursors and corresponding products are as follows:

| UNSATURATED PRECURSOR | PRODUCT |
|---|---|
| $CH_2{=}CF_2$ | $CH_3CF_3$ |
| $CH_2{=}CH_2$ | $CH_3CH_2F$ |
| $CH_2{=}CCl_2$ | $CH_3CCl_2F$ |
| $CF_3CH{=}CH_2$ | $CF_3CH_2CH_2F$ |
| $CF_3CCl{=}CCl_2$ | $CF_3CHClCClF_2$ |
| $CF_3CF{=}CHF$ | $CF_3CHFCHF_2$ |
| $CF_3CH{=}CF_2$ | $CF_3CH_2CF_3$ |
| $CF_3OCF{=}CF_2$ | $CF_3OCHFCF_3$ |

Of particular note are processes where for component (b) a is 0 and b is 2n+1, or less.

The precursor compounds, either individually or in mixed blends, can be fluorinated with the HF azeotrope to provide a variety of compositions wherein the ratio of the fluorination product(s) to a compound selected from the group consisting of $CHF_2CF_3$, $CHF_2CHF_2$, $CH_2FCF_3$, $CH_3CF_3$, $CH_3CHF_2$, $CH_2FCF_2CHF_2$ and $CHF_2CF_2CF_2CHF_2$ is about 1:99, or more (depending upon the azeotropic combination of said compound and HF used, the particular precursor(s) and the degree of fluorination). These fluorinations include processes for producing compositions wherein the molar ratio of component (b) to said compound (a) is between about 1:99 and 15:85 when compound (a) is $CHF_2CF_3$; is between about 1:99 and about 29.5:70.5 when compound (a) is $CHF_2CHF_2$; is between about 1:99 and about 27:73 when compound (a) is $CH_2FCF_3$; is between about 1:99 and about 13.8:86.2 when compound (a) is $CH_3CF_3$; is between about 1:99 and about 8.5:91.5 when compound (a) is $CH_3CHF_2$; is between about 1:99 and about 83:17 when compound (a) is $CH_2FCF_2CHF_2$; and is between about 1:99 and about 96.5:3.5 when compound (a) is $CHF_2CF_2CF_2CHF_2$. This process comprises (A) combining (i) an azeotrope or azeotrope-like composition consisting essentially of compound (a) and HF wherein the ratio of HF to compound (a) is at least equal to the desired ratio of component (b) to the respective component (a) compound, with the precursor component (ii).

Of note are embodiments of this fluorination where the HF azeotropes of a compound selected from the group consisting of $CHF_2CF_3$, $CHF_2CHF_2$, $CH_2FCF_3$, $CH_3CF_3$, $CH_3CHF_2$, $CH_2FCF_2CHF_2$ and $CHF_2CF_2CF_2CHF_2$ which are combined with the precursor(s) are obtained by (1) distilling a product mixture comprising HF and said compound (a) to remove all products which have a lower boiling point than the lowest boiling azeotrope containing HF and said compound (a); and (2) distilling said azeotrope to recover HF as an azeotropic composition containing HF and said compound (a). Of note are processes where the fluorination precursors include precursors for at least two saturated compounds of the formula $C_nH_{2n+2-a-b}Cl_aF_bO_c$ where c is 1 for at least one of said saturated compounds.

These embodiments thus involve azeotropic distillation of HF with a compound selected from the group consisting of $CHF_2CF_3$ (i.e., 1,1,1,2,2-pentafluoroethane or HFC-125); $CHF_2CHF_2$ (i.e., 1,1,2,2-tetafluoroethane or HFC-134); $CH_2FCF_3$ (i.e., 1,1,1,2-tetrafluoroethane or HFC-134a); $CH_3CF_3$ (i.e., 1,1,1-trifluoroethane or HFC-143a); $CH_3CHF_2$ (i.e., 1,1,1-difluoroethane or HFC-152a); $CH_2FCF_2CHF_2$ (i.e., 1,1,2,2,3-pentafluoropropane or HFC-245ca); and $CHF_2CF_2CF_2CHF_2$ (i.e., 1,1,2,2,3,3,4,4-octafluorobutane or HFC-338pcc). The product mixtures distilled can be obtained from a variety of sources. These sources include product mixtures produced by fluorination with HF of $CHCl_2FCF_3$ to afford HFC-125/HF; fluorination with HF of $CHCl_2CHCl_2$ to afford HFC-134/HF; fluorination with HF of $CH_2ClCF_3$ to afford HFC-134a/HF; fluorination with HF of $CH_3CCl_3$ to afford HFC-143a/HF; fluorination with HF of $CH_2{=}CHCl$ to afford HFC-152a/HF; and fluorination with HF of $CH_2ClCF_2CHF_2$ to afford HFC-245ca/HF. The described catalytic fluorination with HF reactions can be done in either the liquid or vapor phase using procedures known in the art.

The product mixture may be distilled to remove all products which have a lower boiling point than the lowest boiling azeotrope containing HF and a compound selected from the group consisting of $CHF_2CF_3$, $CHF_2CHF_2$, $CH_2FCF_3$, $CH_3CF_3$, $CH_3CHF_2$, $CH_2FCF_2CHF_2$ and $CHF_2CF_2CF_2CHF_2$. Such low-boiling materials can include, for example, HCl. For continuous processes, distillate and azeotropes with higher boiling points can be advantageously removed from appropriate sections of the distillation column.

The lowest boiling azeotrope containing HF and one of the following compounds, $CHF_2CF_3$, $CHF_2CHF_2$, $CH_2FCF_3$, $CH_3CF_3$, $CH_3CHF_2$, $CH_2FCF_2CHF_2$ and $CHF_2CF_2CF_2CHF_2$ may then be distilled such that HF is recovered as an azeotropic composition containing HF together with one of the said compounds.

Where the mixture (after distilling components boiling at lower temperatures than the lowest boiling azeotrope of HF with $CHF_2CF_3$) consists essentially of HF and $CHF_2CF_3$, HF may be recovered as an azeotrope consisting essentially of $CHF_2CF_3$ and HF. If excess amounts of $CHF_2CF_3$ or HF remain after azeotropes are recovered from these mixtures, such excess may be recovered as a relatively pure compound. The distillation of azeotropes containing HF and $CHF_2CF_3$ may be done at a wide variety of temperatures and pressures. Typically the temperature is between about −50° C. and about 50° C. and the pressure is between 92 kPa and 2674 kPa. The process of this invention includes embodiments where azeotropic compositions containing from about 85 to about 89 mole percent $CHF_2CF_3$ are recovered. HF may be recovered for example, from a product mixture including $CHF_2CF_3$ formed by the reaction of $CHCl_2CF_3$ with HF.

Where the mixture (after distilling components boiling at lower temperatures than the lowest boiling azeotrope of HF with $CHF_2CHF_2$) consists essentially of HF and $CHF_2CHF_2$, HF may be recovered as an azeotrope consisting essentially of $CHF_2CHF_2$ and HF. If excess amounts of $CHF_2CHF_2$ or HF remain after azeotropes are recovered from these mixtures, such excess may be recovered as a relatively pure compound. The distillation of azeotropes containing HF and $CHF_2CHF_2$ may be done at a wide variety of temperatures and pressures. Typically the temperature is between about −40° C. and about 0° C. (e.g., about −20° C.) and the pressure is between 39 kPa and 240 kPa (e.g., about 105 kPa). Examples of temperatures and pressures suitable for azeotropic formation are provided below. The process of this invention includes embodiments where azeotropic compositions containing from about 70.5 to about 75.5 mole percent $CHF_2CHF_2$ are recovered. HF may be recovered for example, from a product mixture including $CHF_2CHF_2$ formed by the reaction of $CHCl_2CHCl_2$ with HF.

Where the mixture (after distilling components boiling at lower temperatures than the lowest boiling azeotrope of HF with $CH_2FCF_3$) consists essentially of HF and $CH_2FCF_3$, HF may be recovered as an azeotrope consisting essentially of $CH_2FCF_3$ and HF. If excess amounts of $CH_2FCF_3$ or HF remain after azeotropes are recovered from these mixtures, such excess may be recovered as a relatively pure compound. The distillation of azeotropes containing HF and $CH_2FCF_3$ may be done at a wide variety of temperatures and pressures. Typically the temperature is between about −42° C. and about 56° C. and the pressure is between 50 kPa and 1600 kPa. The process of this invention includes embodiments where azeotropic compositions containing from about 73 to about 87 mole percent $CH_2FCF_3$ are recovered. HF may be recovered for example, from a product mixture including $CH_2FCF_3$ formed by the reaction of $CH_2ClCF_3$ with HF.

Where the mixture (after distilling components boiling at lower temperatures than the lowest boiling azeotrope of HF with $CH_3CF_3$) consists essentially of HF and $CH_3CF_3$, HF may be recovered as an azeotrope consisting essentially of $CH_3CF_3$ and HF. If excess amounts of $CH_3CF_3$ or HF remain after azeotropes are recovered from these mixtures, such excess may be recovered as a relatively pure compound. The distillation of azeotropes containing HF and $CH_3CF_3$ may be done at a wide variety of temperatures and pressures. Typically the temperature is between about −25° C. and about 70° C. and the pressure is between 267 kPa and 4101 kPa. The process of this invention includes embodiments where azeotropic compositions containing from about 86.2 to about 95 mole percent $CH_3CF_3$ are recovered. HF may be recovered for example, from a product mixture including $CH_3CF_3$ formed by the reaction of $CCl_3CF_3$ with HF.

Where the mixture (after distilling components boiling at lower temperatures than the lowest boiling azeotrope of HF with $CH_3CHF_2$) consists essentially of HF and $CH_3CHF_2$, HF may be recovered as an azeotrope consisting essentially of $CH_3CHF_2$ and HF. If excess amounts of $CH_3CHF_2$ or HF remain after azeotropes are recovered from these mixtures, such excess may be recovered as a relatively pure compound. The distillation of azeotropes containing HF and $CH_3CHF_2$ may be done at a wide variety of temperatures and pressures. Typically the temperature is between about 45° C. and about 95° C. and the pressure is between 1034 kPa and 3198 kPa. The process of this invention includes embodiments where azeotropic compositions containing from about 91.5 to about 99 mole percent $CH_3CHF_2$ are recovered. HF may be recovered for example, from a product mixture including $CH_3CHF_2$ formed by the reaction of $CH_2{=}CHCl$ with HF.

Where the mixture (after distilling components boiling at lower temperatures than the lowest boiling azeotrope of HF with $CH_2FCF_2CHF_2$) consists essentially of HF and $CH_2FCF_2CHF_2$, HF may be recovered as an azeotrope consisting essentially of $CH_2FCF_2CHF_2$ and HF. If excess amounts of $CH_2FCF_2CHF_2$ or HF remain after azeotropes are recovered from these mixtures, such excess may be recovered as a relatively pure compound. The distillation of azeotropes containing HF and $CH_2FCF_2CHF_2$ may be done at a wide variety of temperatures and pressures. Typically the temperature is between about −10° C. and about 130° C. and the pressure is between 43 kPa and 3385 kPa. The process of this invention includes embodiments where azeotropic compositions containing from about 17 to about 48 mole percent $CH_2FCF_2CHF_2$ are recovered. HF may be recovered for example, from a product mixture including $CH_2FCF_2CHF_2$ formed by the reaction of $CH_2ClCF_2CHF_2$ with HF.

Where the mixture (after distilling components boiling at lower temperatures than the lowest boiling azeotrope of HF with $CHF_2CF_2CF_2CHF_2$) consists essentially of HF and $CHF_2CF_2CF_2CHF_2$, HF may be recovered as an azeotrope consisting essentially of $CHF_2CF_2CF_2CHF_2$ and HF. If excess amounts of $CHF_2CF_2CF_2CHF_2$ or HF remain after azeotropes are recovered from these mixtures, such excess may be recovered as a relatively pure compound. The distillation of azeotropes containing HF and $CHF_2CF_2CF_2CHF_2$ may be done at a wide variety of temperatures and pressures. Typically the temperature is between about −40° C. and about 145° C. and the pressure is between 7.3 kPa and 4115 kPa. The process of this invention includes embodiments where azeotropic compositions containing from about 3.5 to about 36.8 mole percent $CHF_2CF_2CF_2CHF_2$ are recovered. HF may be recovered for example, from a product mixture including $CHF_2CF_2CF_2CHF_2$ formed by the fluorination of $CCl_3CF_2CF_2CCl_3$ to $CClF_2CF_2CF_2CClF_2$ followed by hydrogenolysis in the presence of HF and HCl from the fluorination.

The fluorination product components containing component (a) and component (b) may be separated by conventional means such as distillation, selective sorption and/or decantation. The compositions of this invention comprising components (a) and (b) (including at least one ether) are useful, for example, as aerosol propellants, fire extinguishants and/or refrigerants.

Some of the compounds of the component (a)/component (b) combinations may form HCl azeotropes. The HCl can be separated from those combinations by extractive distillation or sorption on activated carbon. A number of the combinations may boil too close together to separate by distillation forming zeotropic blends (i.e., blends boiling within a limited temperature range). Some of the combinations may form binary or even ternary azeotropes. The azeotropes, zeotropes and individual compounds can be collected form different parts of a distillation column.

The distillation equipment and its associated feed lines, effluent lines and associated units should be constructed of materials resistant to hydrogen fluoride, hydrogen chloride and chlorine. Typical materials of construction, well-known to the fluorination art, include stainless steels, in particular of the austenitic type, and the well-known high nickel alloys, such as Monel® nickel-copper alloys, Hastelloy® nickel-based alloys and, Inconel® nickel-chromium alloys. Also suitable for reactor fabrication are such polymeric plastics as polytrifluorochloroethylene and polytetrafluoroethylene, generally used as linings.

Of note are compositions comprising (a) $CHF_2CHF_2$ and component (b) wherein the molar ratio of component (b) to $CHF_2CHF_2$ is between about 1:99 and about 29.5:70.5. Also of note are processes for producing compositions comprising (a) $CH_2FCF_3$ and (b) $CH_3CF_3$, particularly processes where an azeotrope of $CH_2FCF_3$ and HF is combined with $CH_2{=}CF_2$.

EXAMPLE 1

Preparation of $CHF_2CHF_2$ By Vapor Phase Fluorination of $CHCl_2CHCl_2$

A 30 mL Hastelloy™ (nickel alloy) tubular reactor is packed with 39.9 g of 12–20 mesh (1.68–0.84 mm) chromium(III) oxide catalyst. The catalyst is activated by heating to 175° C. in a nitrogen flow and then is treated with a 1:1 mixture of HF and $N_2$ at 175° C. for about 0.5 hours. The feed gas is then changed to 4:1 HF:$N_2$ and the reactor temperature is increased to 400° C. over the course of 2 hours and then is held at 400° C. for 0.5 hours. The catalyst is then cooled under a nitrogen flow.

A 4:1 mixture of HF and 1,1,2,2-tetrachloroethane is fed to the reactor with a catalyst contact time of 30 seconds at 325° C. The product mixture contains (in wt. %) about 25% $CHF_2CHF_2$ and about 20% $CH_2FCF_3$.

The entire reactor effluent is distilled and lower boiling material, such as HCl, is removed from the top of the distillation column. The $CHF_2CHF_2$/HF azeotrope is removed from a section below the top of the column.

EXAMPLE 2

Reaction of the $CHF_2CHF_2$/HF Azeotrope with $CF_2{=}CF_2$

Preparation of Cubic Chromium Trifluoride

Commercial rhombohedral $CrF_3{\bullet}4H_2O$ (about 3 g) was placed in a gold container and heated to 400° C. for 3–12 hours in air. The product was recovered and characterized. Powder x-ray diffraction measurements were recorded at room temperature using a SCINTAG (PAD IV) commercial diffractometer and indicated that the crystal structure of the product formed can be indexed as cubic with a lattice parameter of 10.201Å (Table 2). The samples were weighed before and after the experiments. Weight loss measurements showed the compound formed at 400° C./6 hours is $CrF_3$ (Table 1) as shown in the equation, $$CrF_3{\bullet}4H_2O \rightarrow CrF_3 + 4H_2O.$$

(Weight loss observed: 39.8%, Weight loss calculated 39.77%). The intensities of X-ray diffraction data show the compound has a face-centered cubic unit cell with space group Fd3m.

TABLE 1

| Temp./time | Obs. Weight loss | Phase formation |
|---|---|---|
| 200° C./12 hr | 25.6% | Amorphous |
| 250° C./6 hr | 28.4 | Amorphous |
| 300° C./6 hr | 31.1% | Amorphous + Cubic |
| 350° C./12 hr | 39.3% | Cubic |
| 400° C./3 hr | 38.6% | Cubic |
| 400° C./6 hr | 39.8% | Cubic |
| 400° C./12 hr | 51.0% | Amorphous + Cubic |
| 500° C./3 hr | 52.4% | $CrOF_2$ + $Cr_2O_3$ + amor. + Cubic |

TABLE 2

Powder X-ray diffraction Data for Cubic-$CrF_3$ ($CrF_3 \cdot 4H_2O$, 400° C./6 hours)

| d spacing (Å) | Relative intensity | H | K | L |
|---|---|---|---|---|
| 5.8888 | 100 | 1 | 1 | 1 |
| 3.0674 | 46 | 3 | 1 | 1 |
| 2.9423 | 33 | 2 | 2 | 2 |
| 2.0818 | 7 | 4 | 2 | 2 |
| 1.9547 | 4 | 5 | 1 | 1 |
| 1.7991 | 14 | 4 | 4 | 0 |

Catalyst Preparation for Use in Hydrofluorination

Commercial $CrF_3{\bullet}4H_2O$ (about 54 g) was placed in a gold container and heated to 400° C. for 3 hours. The product was granulated to form 1.2 to 1.7 mm particles for catalytic evaluation. The granulated product was subsequently treated with anhydrous HF at 400° C. for 4 hours as described below. The x-ray diffraction powder pattern of the product was essentially the same as that given for cubic $CrF_3$ in Table 2.

General Procedure for HF Treatment of Cubic $CrF_3$

The granulated catalyst (9.2 g, 10 mL) was placed in a ⅝" (1.58 cm) Inconel® nickel alloy reactor heated in a fluidized sand bath. It was heated to 175° C. in a flow of nitrogen (50 cc/min) at which time HF flow (50 cc/min) was also started through the reactor. After 15 minutes, the nitrogen flow was decreased to 20 cc/min and the HF flow increased to 80 cc/min. The reactor temperature was gradually increased to 400° C. during a 2 hour period and maintained at 400° C. for an additional 30 minutes. At the end of this period the reactor was brought to the desired operating temperature for catalyst evaluation under a nitrogen flow of 10 cc/min and an HF flow of 50 cc/min.

Hydrofluorination Step

The reactor temperature is maintained at 170° C. and the flows of HF and nitrogen are stopped. To the reactor are fed an azeotrope of HF and $CHF_2CHF_2$ containing 25 mole % HF and $CF_2{=}CF_2$ at a molar ratio of HF:$CF_2{=}CF_2$ of 0.8:1 and at a rate such that the contact time is 30 seconds. The reactor product effluent contains $CHF_2CF_3$.

What is claimed is:

1. A composition comprising:

(a) $CHF_2CHF_2$; and (b) at least two saturated compounds selected from halogenated hydrocarbons and ethers having the formula $$C_nH_{2n+2-a-b}Cl_aF_bO_c$$

wherein n is an integer from 1 to 4, a is an integer from 0 to 2n+1, b is an integer from 1 to 2n+2-a, and c is 0 or 1, provided that when c is 1 then n is an integer from 2 to 4, provided that component (b) does not include $CHF_2CHF_2$ and provided that c is 1 for at least one of the component (b) compounds;

wherein the molar ratio of component (b) to $CHF_2CHF_2$ is between about 1:99 and about 29.5:70.5, said molar ratio of about 29.5:70.5 being a molar ratio of HF to $CHF_2CHF_2$ in an azeotrope or azeotrope-like composition of $CHF_2CHF_2$ with HF.

2. A composition consisting essentially of hydrogen fluoride in combination with an effective amount of $CHF_2CHF_2$ to form an azeotrope or azeotrope-like composition with hydrogen fluoride, said composition containing from about 70.5 to 75.5 mole percent $CHF_2CHF_2$.

3. A composition comprising:

(a) $CHF_2CHF_2$; and (b) at least two saturated compounds selected from halogenated hydrocarbons and ethers having the formula $$C_nH_{2n+2-a-b}Cl_aF_bO_c$$

wherein n is an integer from 1 to 4, a is 0, b is an integer from 1 to 2n+1, and c is 0 or 1, provided that when c is 1 then n is an integer from 2 to 4, provided that component (b) does not include $CHF_2CHF_2$ and provided that c is 1 for at least one of the component (b) compounds;

wherein the molar ratio of component (b) to $CHF_2CHF_2$ is between about 1:99 and about 29.5:70.5, said molar ratio of about 29.5:70.5 being a molar ratio of HF to $CHF_2CHF_2$ in an azeotrope or azeotrope-like composition of $CHF_2CHF_2$ with HF; and wherein said composition is produced by a process comprising (A) combining (i) an azeotrope or azeotrope-like composition of component (a) with HF, with (ii) at least one fluorination precursor compound wherein the precursor component (ii) is the fluorination precursor to component (b); and (B) reacting a sufficient amount of the HF from the azeotrope or azeotrope-like composition (i) with precursor component (ii) to provide a composition containing components (a) and (b) in said ratio.

4. A composition of claim 3 wherein the azeotrope or azeotrope-like composition contains from about 70.5 to 75.5 mole percent $CHF_2CHF_2$.

5. A process for recovering and using HF from a product mixture comprising HF and $CHF_2CHF_2$, comprising:

(1) distilling the product mixture to remove all products which have a lower boiling point than the lowest boiling azeotrope containing HF and $CHF_2CHF_2$;

(2) distilling said azeotrope to recover HF as an azeotropic composition of claim 2 containing HF and $CHF_2CHF_2$; and (3) producing a composition comprising (a) $CHF_2CHF_2$ and (b) at least one saturated compound selected from halogenated hydrocarbons and ethers having the formula:

$$C_nH_{2n+2-a-b}Cl_aF_bO_c$$

wherein n is an integer from 1 to 4, a is an integer from 0 to 2n+1, b is an integer from 1 to 2n+2-a, and c is 0 or 1, provided that when c is 1 then n is an integer from 2 to 4, and provided that component (b) does not include $CHF_2CHF_2$, wherein the molar ratio of component (b) to $CHF_2CHF_2$ is between about 1:99 and a molar ratio of HF to $CHF_2CHF_2$ in the azeotropic composition recovered in (2);

wherein (3) comprises (A) combining (i) said azeotropic composition with (ii) at least one fluorination precursor compound wherein the precursor component (ii) is the fluorination precursor to component (b); and (B) reacting a sufficient amount of the HF from the azeotropic composition (i) with precursor component (ii) to provide a composition containing $CHF_2CHF_2$ and component (b) in said ratio.

6. The process of claim 5 wherein in (B) a catalyst is used which comprises cubic chromium trifluoride having the following X-ray diffraction powder pattern:

| d spacing (Å) | Relative intensity | H | K | L |
|---|---|---|---|---|
| 5.8888 | VS | 1 | 1 | 1 |
| 3.0674 | S | 3 | 1 | 1 |
| 2.9423 | M | 2 | 2 | 2 |
| 2.0818 | W | 4 | 2 | 2 |
| 1.9547 | W | 5 | 1 | 1 |
| 1.7991 | M | 4 | 4 | 0 |

7. The process of claim 5 wherein (b) is $CH_3CF_3$.

8. The process of claim 5 wherein (b) is $CH_3CH_2F$.

9. The process of claim 5 wherein (b) is $CF_3CH_2CF_3$.

10. The process of claim 5 wherein (b) is $CF_3CH_2CHF_2$.

11. The process of claim 5 wherein (b) is $CHF_2OCHF_2$.

12. The composition of claim 2 produced by a process comprising (1) distilling a product mixture comprising HF and $CHF_2CHF_2$ to remove all products which have a lower boiling point than the lowest boiling azeotrope containing HF and $CHF_2CHF_2$; and (2) distilling said azeotrope to recover HF as said the composition.

* * * * *